US005657814A

United States Patent [19]

Maebara et al.

[11] Patent Number: 5,657,814

[45] Date of Patent: Aug. 19, 1997

[54] DIRECT ROLLING METHOD FOR CONTINUOUSLY CAST SLABS AND APPARATUS THEREOF

[75] Inventors: Yasuhiro Maebara, Kobe; Tadao Ebukuro, Nara, both of Japan

[73] Assignee: Sumitomo Metal Industries, Ltd., Osaka, Japan

[21] Appl. No.: 573,360

[22] Filed: Dec. 15, 1995

[30] Foreign Application Priority Data

Dec. 15, 1994 [JP] Japan ..... 6-311876
Aug. 10, 1995 [JP] Japan ..... 7-204409

[51] Int. Cl.[6] ..... B22D 11/16; B21B 1/46

[52] U.S. Cl. ..... 164/452; 164/154.3; 164/154.6; 164/476; 29/527.7

[58] Field of Search ..... 164/476, 417, 164/154.1, 424, 452, 154.3, 154.6; 29/527.7

[56] References Cited

U.S. PATENT DOCUMENTS

| | | | |
|---|---|---|---|
| 4,951,734 | 8/1990 | Hoffken | 164/417 |
| 4,958,677 | 9/1990 | Kimura | 164/476 |
| 5,307,864 | 5/1994 | Arvedi et al. | 164/476 |
| 5,488,987 | 2/1996 | Di Giusto et al. | 164/452 |
| 5,493,766 | 2/1996 | Yamakawa et al. | 29/527.7 |

FOREIGN PATENT DOCUMENTS

| | | |
|---|---|---|
| 0 294 807 | 12/1988 | European Pat. Off. . |
| 0 350 431 | 1/1990 | European Pat. Off. . |
| 742 989 | 12/1943 | Germany . |
| 20 19 699 | 11/1989 | Germany . |
| 56-033103 | 4/1981 | Japan . |
| 60-262915 | 12/1985 | Japan . |
| 2 -137602 | 5/1990 | Japan . |
| 5-68525 | 9/1993 | Japan . |
| 83/02783 | 8/1983 | WIPO . |
| 89/11393 | 11/1989 | WIPO . |

*Primary Examiner*—Joseph J. Hail, III
*Assistant Examiner*—I.-H. Lin
*Attorney, Agent, or Firm*—Burns, Doane, Swecker & Mathis, LLP

[57] ABSTRACT

A direct rolling method and apparatus for a continuously cast slab of steel includes carrying out preliminary rolling of a continuously cast steel slab with a surface temperature of the slab in the range of 900°–1200° C. at a strain rate of $10^{-3}$ to 1 $sec^{-1}$ with a total reduction of greater than 5% and at most 20%. The slab is then subjected to hot rolling after the preliminary rolling.

6 Claims, 4 Drawing Sheets

DIRECT ROLLING METHOD FOR CONTINUOUSLY CAST SLABS AND APPARATUS THEREOF

BACKGROUND OF THE INVENTION

This invention relates to a direct rolling method for continuously cast slabs which can prevent the formation of surface cracks during hot rolling. It also relates to an apparatus for carrying out this method.

In particular, it relates to a method and apparatus for rolling hot cast slabs either immediately after casting or after slightly heating the hot cast slabs to make the temperature in the slab uniform. Such a rolling method is referred to as a direct rolling method. The present invention is particularly applicable to continuously cast Al killed steels, Si-Al killed steels, and low allow steels containing elements such as Nb or V.

In the past, a typical method of forming hot rolled steel plates involved forming a cast slab by continuous casting, allowing the slab to cool to room temperature, soaking the cooled slab in a heating furnace at a high temperature for a long period, and then performing hot rolling. However, in recent years, in order to reduce the energy consumption for hot rolling, a method referred to as direct rolling was developed. In this method, a continuously cast slab is hot rolled either immediately after casting or after slightly heating the slab to obtain a uniform temperature in the slab. In direct rolling, the steps of cooling a slab and then reheating it to a high temperature are omitted, so there is an enormous savings in energy that would otherwise be required for the reheating step. In addition, the formation of scale which results in a decrease in yield can be prevented.

However, in direct rolling, there is the problem of surface cracks, which were not a problem in the conventional hot rolling methods including soaking. Namely, according to the direct rolling process, the temperature of a cast slab which is in the process of cooling from a molten state to a solidified state does not fall below the $Ar_3$ point, so rolling takes place immediately after Solidification in a state in which the slab contains coarse austenite crystal grains, and during the cooling process, impurities such as S, O, and p segregate and precipitate in the austenite grain boundaries. When stress is applied by hot working, cracks form along the grain boundaries, and surface blemishes (referred to below as surface cracks) are formed in the cast slab. In particular, the temperature range in which hot ductility of a cast slab decreases is 800°–1200° C. This coincides with the normal temperature range for hot rolling. The formation of such surface cracks is a great industrial problem and is a major impediment to the increased use of direct rolling.

Various methods are conceivable for increasing the hot ductility of cast slabs in order to prevent the formation of surface cracks during hot rolling. These methods include (1) decreasing the level of impurities in the steel, (2) refining the austenite grains, and (3) agglomerating and coarsening precipitates so as to decrease the number of precipitates at grain boundaries. A number of direct rolling methods employing these concepts for preventing surface cracks have actually been proposed.

However, these proposed methods are not without drawbacks. For example, the level of impurities can be decreased by desulfurization and dephosphorization processes during refining, but these processes unnecessarily decrease the level of S and p, leading to an increase in production costs.

In addition, austenite crystal grains can be refined by performing heavy working at a temperature higher than the temperatures at which precipitation of elements which are harmful to hot workability occurs. During such heavy working, shape control of precipitates is simultaneously carried out, and it is said that hot workability is increased. However, in a conventional continuous casting method, it is difficult from a practical standpoint to feed a hot cast slab to a rolling apparatus while maintaining the temperature of the slab at 1200° C. or higher. For example, special heating equipment for preventing a decrease in the temperature of the cast slab becomes necessary, leading to an increase in equipment costs. Thus, increasing the hot rolling temperature may be impractical from a cost standpoint.

In order to aggregate and coarsen precipitates, it is necessary to maintain a cast slab for a long period in a high temperature range in which harmful elements precipitate or to perform gradual cooling in such a high temperature range. According to Met. Sci. Tech., 1 (1985), p. 111, a slab must be maintained at a constant temperature for at least 10 minutes to achieve the desired results. However, such a long holding period greatly reduces production efficiency and in many cases is impractical.

Thus, the methods which have been proposed in the past are not satisfactory from an industrial standpoint, and in order for the use of direct rolling to increase, there is a need for a more practical method.

Japanese published Examined Patent Application No. 5-68525/1993discloses a method in which a continuously cast slab is subjected to a slight degree of reduction of at most 5% and then held for 1–5 minutes prior to direct rolling. According to that method, the precipitation of harmful precipitates is in fact promoted, and the precipitates are coarsened and rendered harmless prior to the main rolling so that surface cracks can be prevented. Of the various methods which have been proposed thus far, that method is the most practical.

In recent years, however, in order to decrease costs, direct rolling has been carried out using slabs with a thickness of less than 100 mm which are cast at a fairly high speed, and in some cases the slabs are rolled to a final shape without being cut a single time. With such a direct rolling method, holding a slab for more than one minute is frequently difficult or impossible from an operational standpoint, so in this case, the method described in Japanese published Examined Patent Application No. 5-68525/1993 is unsuitable. Accordingly, these is a great need for a direct rolling method which can completely prevent surface cracks when used with thin slabs cast at a high speed.

SUMMARY OF THE INVENTION

It is a general object of the present invention to solve the above-described problems of conventional direct rolling methods.

It is a specific object of the present invention to provide a practical method for direct rolling of cast slabs as thin as 100 mm or less which can prevent the formation of surface cracks.

It is another object of the present invention to provide a method and apparatus for direct rolling of such thin cast slabs, which can prevent the formation of surface cracks, even when the rolling is performed through a combined continuous production line of a continuous casting section and a hot rolling section, i.e., in a high-speed continuous production line with a casting speed of as high as 5 m/min and a hot rolling speed of as high as 100 m/min, for example.

It is a more specific object of the present invention to provide an apparatus for direct rolling of cast slabs as thin as 100 mm or less, which is more feasible from a practical viewpoint.

The present inventors found that even in the temperature range of hot cast slabs obtained by a conventional continuous casting method, which is the temperature range in which cracks are most easily formed during hot rolling, if hot rolling conditions are properly specified, the formation of surface cracks in a cast slab can be completely prevented.

The present invention is based on the finding that if a prescribed preliminary rolling is carried out in a state in which austenite crystal grains are coarse and impurities are made to precipitate in advance along grain boundaries, surface cracks can be effectively prevented. This finding is totally at odds with conventional knowledge in the art.

Namely, if prior to hot rolling, preliminary rolling of a cast slab having a surface temperature of 900°–1200° C. is performed at a strain rate of $10^{-3}$ to 1 $sec^{-1}$ with an overall reduction of at most 20%, hot rolling without the formation of surface cracks can be performed without the need for any holding time. Because there is no holding time, there is no need to decrease the casting, speed or increase the hot rolling speed from optimal values. Thus, casting and hot rolling of high quality slabs can be performed at high efficiency, with low energy consumption, and with low equipment costs.

In one aspect, according to the present invention, a direct rolling method is performed by preliminary rolling of a continuously cast slab having a surface temperature of 900°–1200° C. at a strain rate of $10^{-3}$ to 1 $sec^{-1}$ with a total reduction of greater than 5% and at most 20%.

Subsequent to preliminary rolling, the slab may be coiled using a coiler having a radius of 250–1500 mm, and hot rolling may be performed after uncoiling the slab form the coiler.

In another aspect, the present invention also provides a direct rolling apparatus comprising a continuous casting section where continuous casting of a steel slab is carried out and a preliminary rolling section on a downstream side of the continuous casting section for performing preliminary rolling of cast slabs from the continuous casting section while the surface temperature of the slabs is higher than the $Ac_3$ point. The preliminary rolling section includes pinch rolls and a roll gap controller which controls the roll gap of the pinch rolls to achieve a total reduction of the slab of greater than 5% and at most 20%. A motor is connected to the pinch rolls to vary their rotational speed. A hot rolling section including a series of hot rolling rolls is provided on a downstream side of the pinch rolls.

The apparatus may further include a coiler having a radius of 250–1500 mm disposed on a downstream side of the pinch rolls.

Thus, the present invention is:

(1) A direct rolling method for a continuously cast slab of steel comprising:

carrying out preliminary rolling of a continuously cast steel slab with a surface temperature of the slab in the range of 900°–1200° C. at a strain rate of $10^{-3}$ to $10^{0}$ $sec^{-1}$ with a total reduction of greater than 5% and at most 20%; and hot rolling the slab after the preliminary rolling.

(2) A method as set forth in (1) mentioned above further comprising coiling the slab after preliminary rolling using a coiler and uncoiling the slab prior to the hot rolling.

(3) A method as set forth in (1) or (2) above wherein the surface temperature of the slab before the preliminary rolling is in the range of 1050°–1150° C.

(4) A method as set forth in any one of (1)–(3) above wherein the strain rate is $10^{-2}$ to $10^{-1}$ $sec^{-1}$.

(5) A method as set forth in any one of (1)–(4) above wherein the average total reduction is 7% to 15%.

(6) A method as set forth in any one of (1)–(5) above wherein the thickness of the continuously cast slab prior to preliminary rolling is at most 100 mm.

(7) A direct rolling apparatus comprising:

a continuous casting section for continuous casting of a steel slab;

a preliminary rolling section provided on a downstream side of the continuous casting section for performing preliminary rolling of the steel slab, which comprises pinch rolls, a roll gap controller operatively connected to the pinch rolls and controlling a roll gap of the pinch rolls to achieve a total reduction of the slab of greater than 5% and at most 20%, and a variable speed motor drivingly connected to the pinch rolls to vary the rotational speed of the pinch rolls; and a hot rolling section provided on a downstream side of the preliminary rolling section, which comprises a series of hot rolling rolls.

(8) An apparatus as set forth in (7) above including a coiler section provided between the preliminary rolling section and the hot rolling section.

(9) An apparatus as set forth in (8) above wherein the coiler section has a slab coiler and uncoiler.

(10) An apparatus as set forth in any one of (7)–(9) wherein the pinch rolls are 2 Hi rolls or 4 Hi rolls.

In this description, direct rolling refers to a hot rolling method in which a hot cast slab obtained from a continuous casting machine is rolled without first cooling to below than $Ar_3$ point, including the cases in which the slab is reheated or subjected to short heating to obtain a uniform temperature in the slab after casting and prior to hot rolling. A method in which continuous casting and hot rolling are performed in succession will be referred to as continuous direct rolling.

The total reduction refers to a reduction of a slab, which is determined as a whole. This is because a hot slab exhibits varied degrees of resistance to deformation depending on its place within the slab due to a difference in temperature, and accordingly the reduction ratio is also varied depending on its site of determination. Thus, the total reduction means an overall reduction in a usual sense in this specification.

The surface temperature of a cast slab refers to the average temperature of the entire region of the slab extending to a depth of 10 mm form the surface of the slab. This is because the temperature within a hot slab is higher than that in the very surface area. The surface temperature, therefore, can be determined by calculating the average temperature in a region extending to a depth of 10 mm from the surface on the basis of a difference in temperature between the surface and a 10 mm deep region, where the temperature can also be calculated on the basis of casting speed, dimensions, cooling medium, etc.

DESCRIPTION OF PREFERRED EMBODIMENTS

Figure 1:
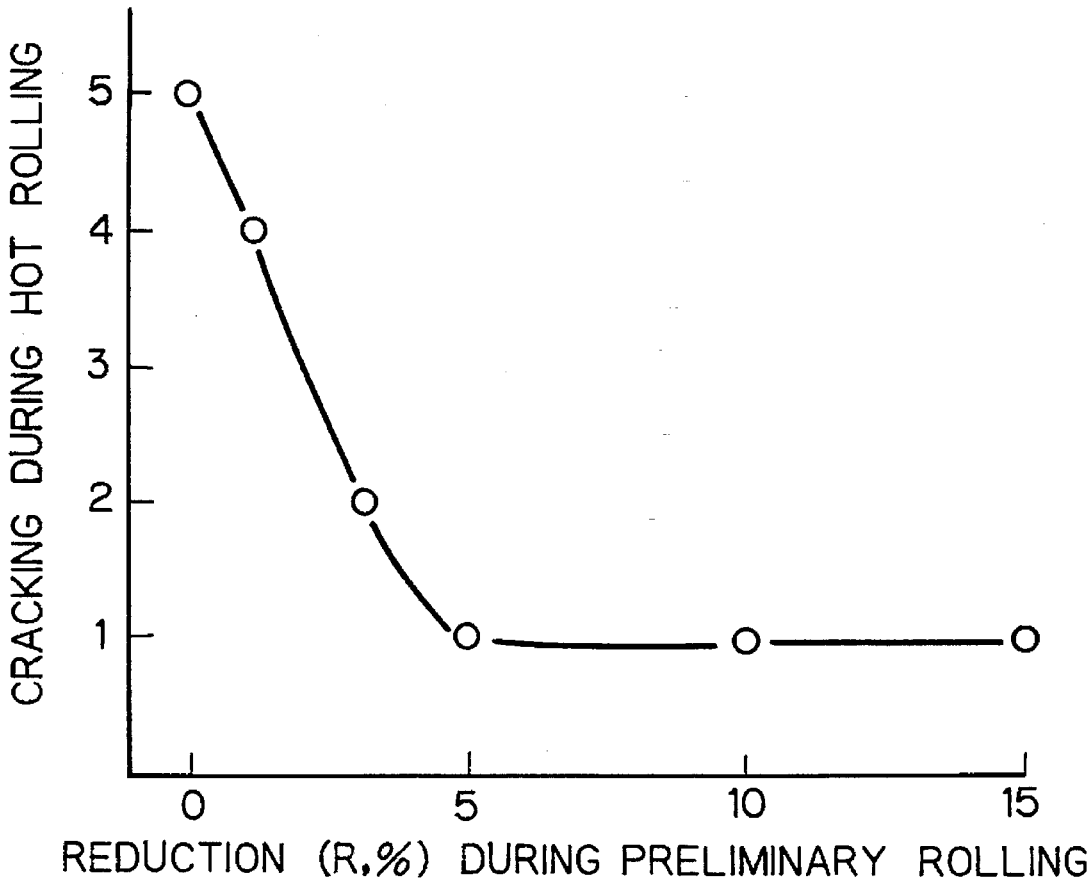
FIG. 1 is a graph showing the relationship between the occurrence of surface cracks during secondary rolling and the reduction R during preliminary rolling.

The reasons for the limitations given above for the rolling conditions in a direct rolling method according to the present invention are as follows.

According to the present invention, hot rolling performed after continuous casting is divided into preliminary rolling and secondary rolling, i.e., the main rolling, hereunder sometimes referred to merely as hot rolling. During preliminary rolling, the surface temperature of a slab being rolled is at least 900° and at most 1200° C. If the surface temperature during rolling exceeds 1200° C., harmful elements do not precipitate, so aggregation and coarsening of harmful precipitates in order to render them harmless does not take place, resulting in the danger of the formation of cracks during secondary rolling. Furthermore, from a practical standpoint, it is difficult to maintain the temperature of a continuously cast slab above 1200° C. during rolling. On the other hand, if the surface temperature falls below 900° C., elements such as Al and Nb precipitate in the form of AlN and NbC, so in order to guarantee the properties of the final product, it is necessary to subsequently dissolve these elements in a matrix of steel by reheating at a temperature of at least 1150° C., resulting in an increase in energy costs, which is contrary to the aim of direct rolling. Therefore, preliminary rolling is preferably performed with the surface temperature in the range of 900°–1200°C. and more preferably in the range of 1050°–1150°C.

Next, the reasons for restricting the strain rate during preliminary rolling to $10^{-3}$ to $10^{0}$ $sec^{-1}$ and the overall reduction during preliminary rolling to greater than 5% and at most 20% will be explained. The total reduction would have a direct influence on the formation of cracks during secondary rolling. The goal of these restrictions is to promote the precipitation of impurities within austenite crystal grains and to coarsen precipitates along the grain boundaries.

The ability of rolling to promote the precipitation of harmful elements during subsequent holding in a furnace saturates when the average total reduction exceeds 20%, and the danger of forming cracks during preliminary rolling increases. If the total reduction is greater than 5%, contrary to conventional wisdom, at a rolling temperature of 900°C. or above, as a result of the introduction of dislocations as precipitation sites for MnS etc., precipitation and aggregation and coarsening of precipitates are promoted, and as a result, the holding time can be further decreased.

According to Japanese published Examined Patent Application No. 5-68525/1993, which was described above, the formation of cracks was observed with a reduction of 15–20% during preliminary rolling and a holding time of 2–5 minutes. However, as a result of subsequent research, when the reduction is high, while increasing the holding time, hot embrittlement by a different mechanism in which carbides and nitrides such as NbC and VN continuously precipitate in the γ grain boundary is observed. It has been found that holding is not necessary, and a small degree of reduction under prescribed conditions is essential, and as a result cracking during secondary rolling can be completely prevented.

Namely, during deformation by a small degree of rolling at a relatively low strain rate, harmful precipitates such as sulfides substantially complete their precipitation and are coarsened, and fine precipitates which can lead to cracking during subsequent secondary rolling are not formed.

If the strain rate during preliminary rolling is greater than $10^{0}$ $sec^{-1}$, there is the possibility of the formation of cracks. Thus, in the present invention, the upper limit on the strain rate is $10^{0}$ $sec^{-1}$ in order to prevent the formation of cracks during preliminary rolling. There is no absolute lower limit on the strain rate, but if it is too low, the efficiency of the method is poor, the slab temperature decreases markedly during rolling, and the productivity of secondary rolling is decreased. Therefore, the strain rate is preferably at least $10^{-3}$ $sec^{-}$. More preferably, it is at least $10^{-2}$ and at most $10^{-}sec^{-1}$.

The strain rate and the total reduction are preferably selected taking each other into consideration. With the above ranges for the total reduction and the strain rate, in order not to form cracks during preliminary rolling at a strain rate of $10^{0}$ $sec^{-1}$, the total reduction is at most 20%.

From a practical standpoint, the total reduction is preferably greater than 7% and less than 15%, and the strain rate is preferably at least $10^{-2}$ to at most $10^{-1}$ $sec^{-1}$.

In a preferred mode of the present invention, preliminary rolling of a slab in the process of solidification and cooling is carried out in the range of 1050°–1150°C in which precipitation of harmful elements can take place. The preliminary rolling can be performed using strong pinch rolls (such as 2 Hi pinch rolls) or it can be carried out subsequently using a usual rolling apparatus. The "strong" pinch rolls means pinch rolls which can perform reduction in thickness of cast slabs. The strain rate at this time is preferably $10^{2}$ to $10^{-1}$ $sec^{-1}$ with a total reduction of larger than 5% and at most 20%.

After preliminary rolling, secondary rolling can immediately be performed without any holding period. In order to maintain the quality of the final product, the slab temperature at the start of secondary rolling is preferably at least 1000°C. and more preferably at least 1100°C.

In recent years, in order to decrease energy consumption, so-called unsolidified rolling has been performed in which a slab cast at a high speed is rolled before the entire slab has solidified. In this process, the precipitated state of nonmetallic inclusions in the surface portion of the slab in which cracks are formed during secondary rolling is important. Preferably, preliminary rolling is performed with an average reduction of 7–15% in a surface portion extending to a depth of 10 mm from the surface.

In this manner, if prescribed reduction at a relatively low strain rate is performed, even in the temperature range in which cracking tended to occur with conventional hot rolling, surface cracks in cast slabs can be suppressed without the need for any holding prior to rolling, and secondary rolling can be performed under usual hot rolling conditions.

FIG. 1 illustrates the relationship between the formation of cracks and the reduction during preliminary rolling of an Si-Al killed steel having the composition shown in Table 1. Ingots of this steel which were processed in a vacuum had initial dimensions of 50 mm (thickness)×100 mm (width)× 150 mm (length). When the surface temperature reached 1100°C., the ingots were subjected to preliminary rolling with various amounts of reduction at a strain rate of $5\times10^{-2}$ $sec^{-1}$. Secondary rolling, i e., hot rolling was then performed at a strain rate of $5\times10^{0}$ $sec^{-1}$ to obtain a total reduction of 50%. It can be seen that the formation of cracks during secondary rolling was prevented when the reduction during preliminary rolling was greater than 5%.

The condition of the slabs was evaluated according to the following scale:

1: no cracks
2: presence of cracks having a length of 1/20 or less of the slab thickness
3: presence of cracks having a length of 1/10 or less of the slab thickness
4: presence of cracks having a length of 1/5 or less of the slab thickness
5: presence of cracks having a length of more than 1/5, of the slab thickness.

TABLE 1

| Element | C | Si | Mn | P | S | Al | N | Fe |
|---|---|---|---|---|---|---|---|---|
| Weight % | 0.03 | 0.02 | 0.24 | 0.010 | 0.014 | 0.035 | 0.0035 | bal. |

Figure 2:
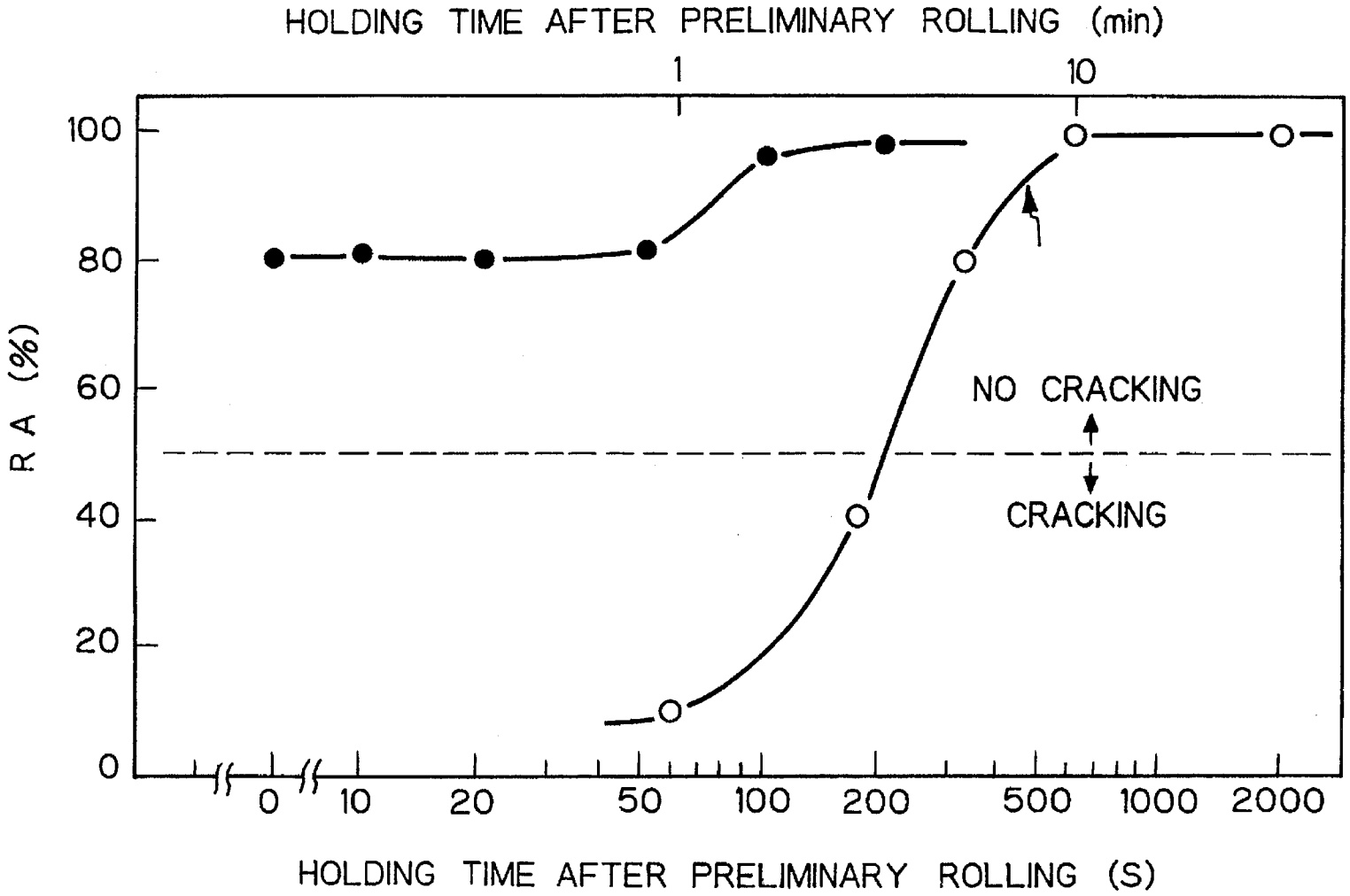
FIG. 2 is graph showing the relationship between the RA during hot rolling and the holding time after preliminary rolling.

FIG. 2 is graph showing the relationship between the RA and the holding time during secondary rolling.

Test pieces measuring 10 mm in diameter in the straight portion were cut from the ingots of the steel of Table 1. After heating to 1350° C., the temperature of the test pieces was allowed to drop to 1000° C., and preliminary deformation of 10% corresponding to preliminary rolling was imparted at a strain rate of $5\times10^{-2}$ $sec^{-1}$ After holding at 1000° C. for various lengths of time, the test pieces were deformed at a strain rate of 5 $sec^{-1}$ until failure in order to simulate secondary rolling and measure ductility. Results thereof are shown in FIG. 2. As can be seen by the ● mark in FIG. 2, as a result of preliminary deformation, the ductility was greatly increased during the deformation corresponding to secondary rolling. This is due to harmful precipitates being rendered harmless by coarsening. It was verified that in order to obtain this effect by the conventional method not employing preliminary deformation, it is necessary to performing holding for 10 minutes (○ marks in FIG. 2).

The metallurgical reasons why imparting preliminary strains corresponding to preliminary rolling increased the ductility of the test pieces during deformation corresponding to secondary rolling, i.e., usual hot rolling are thought to be as follows.

Intergranular fracture of austenite during hot rolling occurs because S in solid solution precipitates along grain boundaries as well as within grains during hot rolling, and the inside of grains is hardened due to such dynamic precipitation of S within grains. When strains concentrate along the grain boundaries, therefore, separation occurs in grain boundaries between intergranular precipitates and the austenite phase matrix. On the other hand, according to the present invention, if preliminary rolling is performed under suitable conditions, S in solid solution precipitates as MnS and coarsening will take place during such preliminary rolling, and the above-described dynamic precipitation of S will not take place, so embrittlement will not occur.

As already stated, there are no particular restrictions on the conditions for secondary rolling which takes place after preliminary rolling, and they may be usual hot rolling conditions. An example of suitable conditions is 5–10passes performed with a reduction of 10–50% per pass at a strain rate of $10^0$ to $10^3$ $sec^{-1}$.

In this manner, according to the present invention, it is possible to perform continuous processing of a thin cast slab having a thickness of as small as 100 mm or less with a casting speed of 5 meters per minute and a hot rolling speed of 100 meters per minute. Therefore, the invention has great practical significance.

EXAMPLES

The present invention will be further described by the following examples, which are presented merely for illustrative purposes and are not intended to limit the invention in any way.

Example 1

Cast slabs of steels having the compositions shown in Table 2 were formed by continuous casting. After casting, during cooling from a solidified state, preliminary rolling of the slabs was carried out under various conditions, and then secondary rolling which was normal hot rolling was performed. The formation of surface cracks in the cast slabs during preliminary and secondary rolling was investigated. The results are compiled in Table 2. Surface cracks were considered to exist even if only minute cracks were present.

The cast slabs, which measured 90 mm thick and 1000 mm wide, were formed in a continuous casting machine at a casting speed of 5 meters per minute from a steel produced in a converter. After solidification, test pieces measuring 10 meters long were obtained by gas cutting. The test pieces were cooled at approximately 0.15°C./sec to the rolling temperature and then fed to a rolling machine. In this case, the cooling time was considered as holding time. During the preliminary rolling, the strain rate was controlled by varying the roll diameter and other parameters of the rolling machine. After a holding time of less than 1 minute after preliminary rolling, the slab was continuously introduced to a secondary rolling machine.

As is clear from the results shown in Table 2, if preliminary rolling was not carried out and a hot cast slab was subjected to direct rolling under normal rolling conditions, cracks were formed regardless of the type of steel. Furthermore, when the preliminary rolling conditions were outside the ranges according to the present invention, cracks formed during preliminary rolling or secondary rolling. Testing of a test piece was terminated if cracking took place during preliminary rolling.

In contrast, according to the present invention, in no case did cracking occur.

TABLE 2

| | Chemical Composition (wt %) | | | | | | | |
|---|---|---|---|---|---|---|---|---|
| Steel | C | Si | Mn | P | S | Al | N | Others |
| Low-Carbon Al-killed Steel | 0.01~0.08 | ≦0.05 | 0.15~0.25 | 0.015~0.028 | 0.015~0.025 | 0.020~0.072 | 0.0020~0.075 | — |
| Medium- | 0.10~0.18 | 0.07~0.25 | 0.45~1.20 | 0.010~0.018 | 0.008~0.018 | 0.018~0.042 | 0.0018~0.012 | Ca: 0~0.0030 |

TABLE 2-continued

| | | | | | | | | |
|---|---|---|---|---|---|---|---|---|
| Carbon Si—Al-killed Steel | | | | | | | | |
| Low-Alloy Steel | 0.08~0.12 | 0.07~0.25 | 0.80~1.52 | 0.012~0.018 | 0.005~0.018 | 0.015~0.052 | 0.002~0.0110 | Nb: 0~0.04<br>V: 0~0.08<br>Ti: 0~0.05 |

| | Preliminary Rolling | | | Holding Time | Secondary | | |
|---|---|---|---|---|---|---|---|
| Steel | Initial Temp. (°C.) | Strain rate ($sec^{-1}$) | Reduction (%) | (Cooling Time) (s) | Rolling (Hot Rolling) | Surface Cracking | Remarks |
| Low-Carbon Al-killed Steel | 1080 | $2 \times 10^{-1}$ | 18 | 10 | Each pass with a Reduction of 15~40% to 3.2 mm thick through 8 passes | none | Present Invention |
| | 1120 | $8 \times 10^{-1}$ | 7 | 30 | | none | |
| | 1070 | $2 \times 10^{-1}$ | 25* | — | | Cracking during preliminary rolling | Comparative |
| | 1100 | $2 \times 10^{-1}$ | 18 | 5* | | Cracking during secondary rolling | |
| | —* | —* | —* | —* | | Cracking during secondary rolling | |
| Medium-Carbon Si—Al-killed Steel | 1060 | $3 \times 10^{-2}$ | 12 | 20 | Each pass with a Reduction of 15~40% to 3.2 mm thick through 8 passes | none | Present Invention |
| | 1080 | $6 \times 10^{-1}$ | 8 | 30 | | none | |
| | 1070 | $2 \times 10^{2}$* | 18 | — | | Cracking during preliminary rolling | Comparative |
| | 1070 | $1 \times 10^{0}$ | 25* | — | | Cracking during preliminary rolling | |
| | —* | —* | —* | —* | | Cracking during secondary rolling | |
| Low-Alloy Steel | 1070 | $3 \times 10^{-2}$ | 10 | 30 | Each pass with a Reduction of 15~40% to 3.2 mm thick through 8 passes | none | Present Invention |
| | 1150 | $5 \times 10^{-1}$ | 15 | 12 | | none | |
| | 1070 | $1 \times 10^{1}$* | 20 | — | | Cracking during preliminary rolling | Comparative |
| | 1080 | $1 \times 10^{0}$ | 25* | — | | Cracking during preliminary rolling | |
| | —* | —* | —* | —* | | Cracking during secondary rolling | |

(Note) *: Outside the range of the present invention.

Example 2

The three types of steels shown in Table 3 were continuously cast to form slabs. The slabs were subjected to preliminary rolling under various conditions as they were cooling from a solidified state. After the preliminary rolling, secondary rolling which was normal hot rolling was performed. The formation of surface cracks during preliminary and second rolling was investigated.

The rolling conditions and the results are shown in Table 3. A sample was considered to have surface cracks whenever even minute cracks were observed.

The slabs were formed from molten steel produced in a converter. The molten steel was formed into slabs having a thickness of 90 mm and a width of 1000 mm in a continuous casting machine having a casting speed of 5 meters per minute. After solidification, test pieces having a length of 10 meters were obtained by gas cutting. After being cooled at approximately 0.15° C./sec to the rolling temperature, the samples were fed to a rolling machine. In this case, the cooling period of time was taken as holding time. The strain rate during preliminary rolling was adjusted by varying the roll diameter and other parameters. With a holding period of less than 1 minute after preliminary rolling, the test pieces were continuously supplied to the secondary rolling machine.

TABLE 3

| | Chemical Composition (wt %) | | | | | | | |
|---|---|---|---|---|---|---|---|---|
| Steel | C | Si | Mn | P | S | Al | N | Others |
| Low-Carbon Al-killed Steel | 0.01~0.08 | ≦0.05 | 0.15~0.30 | 0.010~0.028 | 0.004~0.025 | 0.020~0.072 | 0.0015~0.0075 | Nb ≦ 0.03<br>Ti ≦ 0.04 |
| Medium-Carbon Si—Al-killed Steel | 0.10~0.18 | 0.07~0.25 | 0.45~1.20 | 0.010~0.025 | 0.008~0.020 | 0.018~0.042 | 0.0018~0.0120 | Ca ≦ 0.0030 |

TABLE 3-continued

| | | | | | | | | |
|---|---|---|---|---|---|---|---|---|
| Low-Alloy | 0.08~0.15 | 0.07~0.50 | 0.80~1.80 | 0.010~0.025 | 0.005~0.018 | 0.015~0.052 | 0.002~0.0110 | Nb: ≦ 0.05<br>V ≦ 0.08<br>Ti ≦ 0.05 |

| | Preliminary Rolling | | | Holding Time | Secondary Rolling | | | |
|---|---|---|---|---|---|---|---|---|
| Steel | Initial Temp. (°C.) | Strain rate ($sec^{-1}$) | Reduction (%) | (Cooling Time) (s) | Initial Temp. (°C.) | Reduction Conditions | Surface Cracking | Remarks |
| Low-Carbon | 1080 | 0.05 | 18 | — | 1000 | Each pass | none | Present |
| Al-killed | 1070 | 0.05 | 10 | 50 | 980 | with a | none | Invention |
| Steel | 1100 | 0.50 | 7 | 50 | 980 | Reduction of | none | |
| | 1070 | 0.01 | 15 | — | 1000 | 15~40% to | none | |
| | 1150 | 0.70 | 15 | — | 1090 | 3.2 mm thick | none | |
| | 1090 | 0.05 | 6 | — | 1020 | through | none | |
| | 1100 | 2* | 20 | — | — | 8 passes | Cracking during preliminary rolling | Comparative |
| | —* | —* | —* | — | 1050 | | Cracking during secondary rolling | |
| | 1090 | 0.70 | 28* | — | — | | Cracking during preliminary rolling | |
| Medium- | 1060 | 0.03 | 15 | — | 1090 | Each pass | none | Present |
| Carbon | 1100 | 0.70 | 10 | — | 1010 | with a | none | Invention |
| Si—Al- | 1070 | 2* | 24 | — | — | Reduction of | Cracking during preliminary rolling | Comparative |
| killed Steel | 1080 | 0.85 | 30* | — | — | 15~40% to 3.2 mm thick through | Cracking during secondary rolling | |
| | 1150 | 0.05 | 7 | 50 | 1060 | 8 passes | none | Present Invention |
| | —* | —* | —* | — | 1000 | | Cracking during secondary rolling | Comparative |
| Low-Alloy | 1150 | 0.05 | 15 | — | 1090 | Each pass | none | Present |
| Steel | 1160 | 0.05 | 15 | 50 | 1070 | with a | none | Invention |
| | 1100 | 0.008 | 30* | — | — | Reduction of 15~40% to | Cracking during preliminary rolling | Comparative |
| | —* | —* | —* | — | 1000 | 3.2 mm thick through 8 passes | Cracking during secondary rolling | |

(Note) *: Outside the range of the present invention.

As can be seen from the results in Table 3, when direct rolling of a hot cast slab was performed under normal rolling conditions without first performing preliminary rolling, cracks developed during rolling for each type of steel. In addition, when the preliminary rolling conditions were outside the ranges specified in the present invention, cracks developed during preliminary rolling or secondary rolling. Testing of a test piece was terminated if cracks developed during preliminary rolling.

In contrast, no cracks were formed in any of the examples of the present invention.

Example 3

Figure 3:
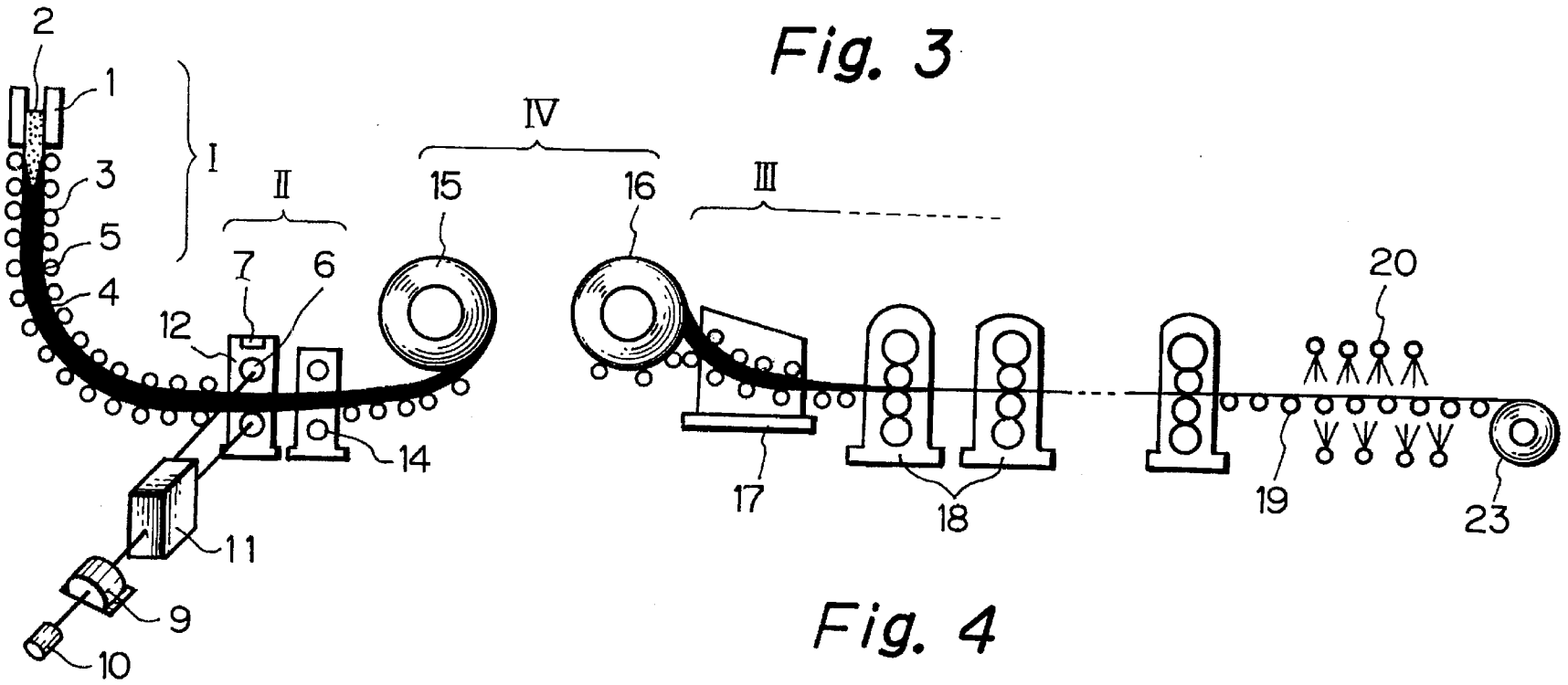
FIG. 3 is a schematic plan view of a production line employing a direct rolling apparatus according to the present invention.

FIG. 3 illustrates an example of a direct rolling apparatus according to the present invention, which comprises a continuous casting section I including a continuous casting machine, a preliminary rolling section II provided on the downstream thereof including strong pinch rolls, and a hot rolling section III. In this embodiment, there is provided a coiler section IV between the preliminary rolling section II and the hot rolling section III.

In Section I, molten steel 2 is poured into a mold 1 of a continuous casting machine. The molten steel 2 passes through the mold 1, and upon reaching the lower end of the mold 1, it has cooled to form a slab 4 having a surface which is solidified and an interior which is unsolidified. The slab 4 enters a group of rollers 3 disposed facing the front and back sides of the slab 4. The slab 4 continues to cool as it is transported by the rollers 3, and when the slab 4 reaches solidification point 5, the center of the slab 4 has solidified.

In the preliminary rolling section II strong pinch rolls 12 supported by bearings 6 are disposed at the downstream end of the rollers 3. Pinch rolls are also found in conventional continuous casting machines, but they are normally used simply to pull a slab forward and do not decrease the thickness of the slab. In contrast, in the present invention, the strong pinch rolls 12 perform reduction of the slab 4. That is, preliminary rolling is carried out at this stage of processing.

In this example, the thickness of the slab 4 is decreased from 60 mm to 54 mm by the strong pinch rolls 12.

The pinch rolls employed in the present invention are different from conventional pinch rolls in the following two points:

First, a hydraulic reduction apparatus 7 is provided for adjusting the roll gap between the pinch rolls 12. In the present invention, a dummy bar is employed to prevent molten steel from flowing out of the mold 1 at the start of casting and in order to pull the leading end of the slab through the rollers 3 and the strong pinch rolls 12. The dummy bar in this example is made of steel and has a thickness of 60 mm. Therefore, the hydraulic reduction apparatus 7 maintains the roll gap between the pinch rolls 12 at 60 mm until the dummy bar has passed between the pinch rolls 12 and the leading end of the slab has reached the exit side of the pinch rolls 12. Thereafter, the roll gap is reduced to 54 mm.

Second, the pinch rolls 12 are driven by a variable speed motor 9 through a speed reduction mechanism 11. A variable speed motor is employed because the speed of the pinch rolls 12 is increased as the slab 4 is being reduced from 60 mm to 54 mm. An unillustrated position sensor which senses the position of the hydraulic reduction apparatus 7 and a rotational speed sensor 10 which senses the rotational speed of the motor 9 (which is proportional to the rotational speed of the pinch rolls 12) provide input signals to an unillustrated computer. Based on the input signals, the computer controls the hydraulic reduction apparatus 7 and the variable speed motor 9 based on a predetermined relationship between reduction and the rotational speed of the pinch rolls 12 while getting feedback from the sensors to gradually decrease the roll gap between the pinch rolls 12 and simultaneously increase their rotational speed.

Conventional pinch rolls are equipped with a mechanism for adjusting their speed and roll gap, too. But the roll gap is adjusted based on the thickness of the slab as it emerges from the mold merely for the purpose of pinching the slab in conventional pinch rolls, and the load applied by the reduction mechanism is low. Furthermore, in conventional pinch rolls, the pinch roll speed is adjusted to compensate for an increase in the speed of the slab from the start of casting and to adjust for variations in the level of the molten steel within the mold. Thus, the manner in which conventional pinch rolls are adjusted is totally different from in the present invention.

A roller table on the exit side of the strong pinch rolls 12 is driven by a variable speed motor. In the example of FIG. 3, from the start of continuous casting until the dummy bar and the leading end of the slab 4 have passed through the pinch rolls 12, the peripheral speed of the rollers 3 on the entrance side of the pinch rolls 12 and the peripheral speed of the rollers on the roller table are the same. However, as the roll gap of the pinch rolls 12 is changed from 60 mm to 54 mm, the peripheral speed of the rollers in the roller table is gradually increased with respect to the peripheral speed of the rollers 3. The unillustrated computer calculates an optimal speed based on the roll gap between the pinch rolls 12 and controls the roller table accordingly.

As an example, when the slab thickness reaches 54 mm, the peripheral speed of the rollers 3 on the entrance side of the pinch rolls 12 is 4.5 meters per minute and the peripheral speed of the rollers in the roller table is 5 meters per minute.

Figure 4:
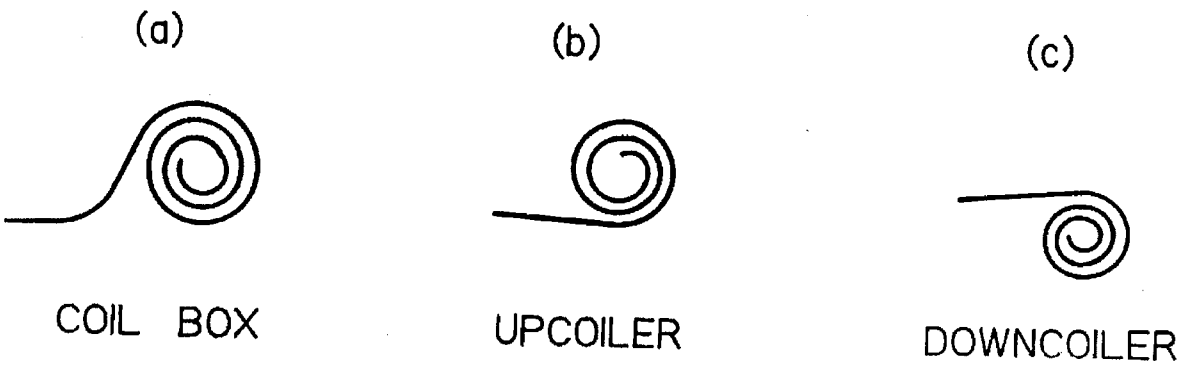
FIGS. 4*a*–4*c* are schematic views of different types of slab coilers.

In this example, a coiler section IV comprising a slab coiler 15 and uncoiler 16 is provided. Accordingly, before going into the coiler section IV, using a slab shearing machine 14 provided at the upstream end of the roller table, the dummy bar is cut from the leading end of the slab 4, and then after passing through the roller table the preliminary rolled slab 4 is cut to lengths corresponding to that of hot rolled coils. The cut slabs are then coiled by a slab coiler 15 having a radius of 250–1500 mm, for example, to form coils. The coils are transferred to an uncoiler 16. The coiler 15 may be any type of coiler, such as a coiler box coiler which forms coils in the manner shown in FIG. 4*a*, an up-coiler which forms coils in the manner shown in FIG. 4*b*, or a down-coiler which forms coils in the manner shown in FIG. 4*c*. If desired, a mandrel may be inserted into the coil during coiling.

When the coil is uncoiled by the uncoiler 16, the resulting slab is passed through a straightener 17 by which the slab is made substantially flat. It then passes through a plurality of rolling stands 18 and is reduced to a predetermined thickness. As the slab passes along a runout table 19 disposed downstream of the rolling stands 18, it is water cooled or air cooled by a cooling mechanism 20 and is then coiled by a coiler 23 disposed downstream of the cooling mechanism 20, thereby completing the hot rolling process.

In this example, six rolling stands 18 reduce the slab thickness from 54 mm to 1.2 mm. The speed of the slab at the entrance of the first rolling stand 18 is 15 meters per minute, and the speed at the exit of the last rolling stand 18 is 675 meters per minute.

Example 4

Figure 5:
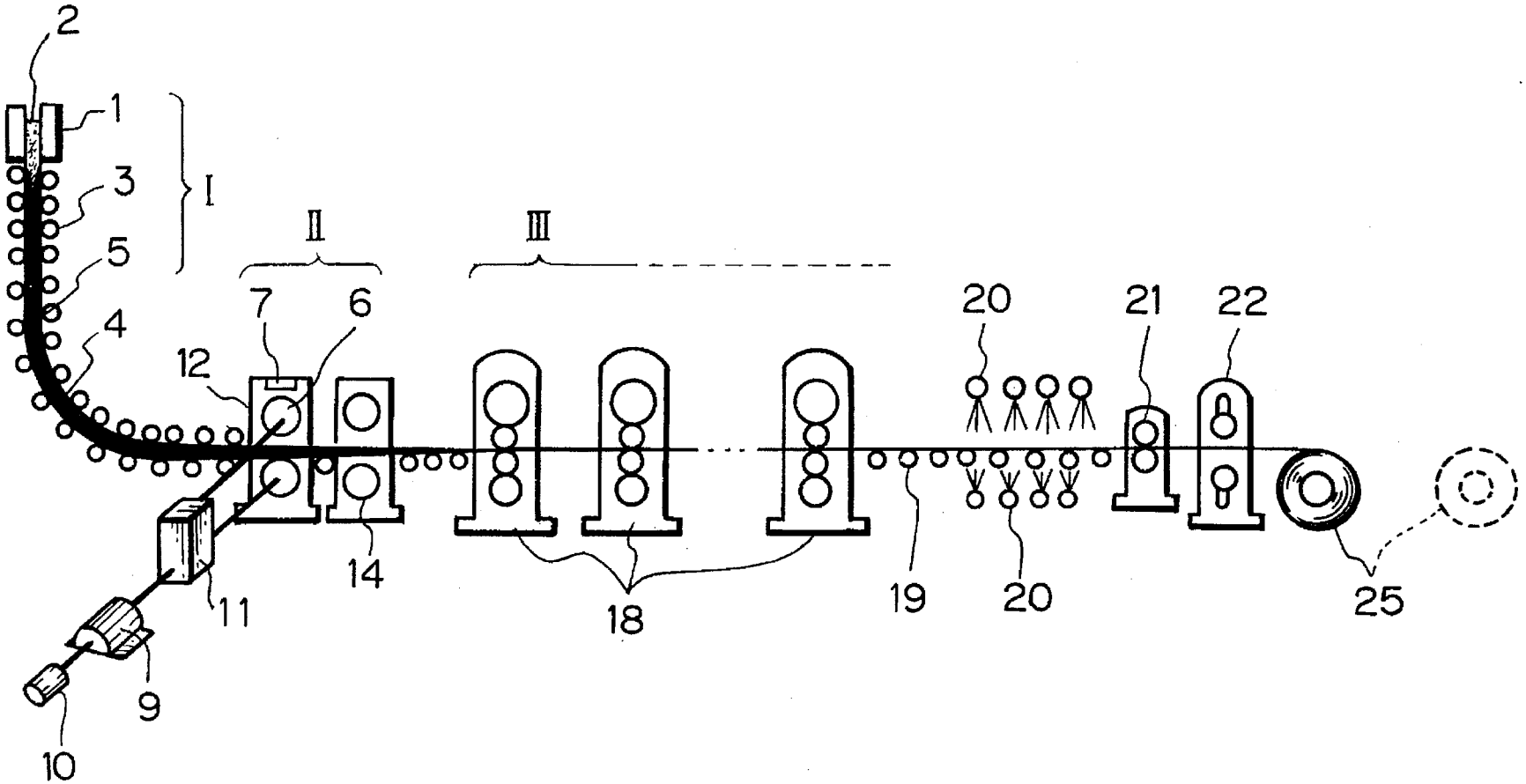
FIG. 5 is a schematic plan view of another production line employing a direct rolling apparatus according to the present invention.

FIG. 5 shows another example of a direct rolling apparatus according to the present invention which includes a continuous casting section I including a continuous casting machine, a preliminary rolling section II including strong pinch rolls, and a hot rolling section III continuously connected to the preliminary rolling section II. This example differs from the example of FIG. 3 in that the coiler 15, the uncoiler 16, and the straightener 17 of FIG. 3 have been omitted. In addition, another set of pinch rolls 21 and an additional shearing machine 22 are provided between rolling stands 18 and the final coiler 25.

The structure and operation of the example of FIG. 5 are the same as for the example of FIG. 3 from the point when molten steel is pored into the mold 1 until the slab emerges from pinch rolls 12. Thus, after the dummy bar and the leading end of the slab have passed through the strong pinch rolls 12, the roll gap between the pinch rolls 12 is decreased to reduce the thickness of the cast slab 4 from 60 mm to 54 mm. The speed of the slab is 4.5 meters per minute at the entrance side of the pinch rolls 12 and is 5 meters per minute on the exit side.

The shearing machine 14 is provided on the downstream side of pinch rolls 12 merely for the purpose of cutting the dummy bar from the leading end of the slab 4. The slab then normally passes as a continuous length through the rolling stands 18, the runout table 19, the cooling mechanism 20, and pinch rolls 21 before being cut by shearing machine 22 to a length corresponding to the length of a coil. The thus-hot rolled steel sheet is then coiled by coiler 25 to complete the hot rolling process.

In this example, there were four rolling stands 18 which reduced the slab thickness from 54 mm to 2.7 mm. The speed of the slab was 5 meters per minute at the entrance of the first rolling stand 18 and was 100 meters per minute at the exit of the last rolling stand 18. A plurality of coilers 25 were provided at the end of the rolling line so that one coiler 25 could be used for coiling while another coiler 25 could be unloaded after forming a coil and prepared for subsequent use.

Although not shown, the examples of FIGS. 3 and 5 may include other equipment conventionally used in continuous casting and hot rolling, such as descalers, measurement devices such as thickness gauges and temperature sensors, and a device for removing the dummy bar.

The frame for the pinch rolls 12 can be part of the housing for the rolling machines 18, and there may be one roller drive motor. The pinch rollers may be of 2 Hi or 4 Hi rollers.

It will be appreciated by those skilled in the art that numerous variations and modifications may be made to the invention as described above with respect to specific embodiments without departing from the spirit or scope of the invention as broadly described.

What is claimed is:

1. A direct rolling method for a continuously cast slab of steel comprising:

carrying out preliminary rolling of a continuously cast steel slab with a surface temperature of the slab in the range of 900°–1200° C. at a strain rate of $10^{-3}$ to $10^{0}$ $sec^{-1}$ with a total reduction of greater than 5% and at most 20%; and hot rolling the slab after the preliminary rolling with a holding time of less than one minute between the preliminary rolling and the hot rolling.

2. A method as set forth in claim 1 further comprising coiling the slab after preliminary rolling using a coiler and uncoiling the slab prior to the hot rolling.

3. A method as set forth in claim 1 wherein the surface temperature of the slab before the preliminary rolling is in the range of 1050°–1150° C.

4. A method as set forth in claim 1 wherein the strain rate is $10^{-2}$ to $10^{-1}$ $sec^{-1}$.

5. A method as set forth in claim 1 wherein the total reduction is 7% to 15%.

6. A method as set forth in claim 1 wherein the thickness of the continuously cast slab prior to preliminary rolling is at most 100 mm.

* * * * *